United States Patent [19]

Törnell

[11] Patent Number: 4,640,623

[45] Date of Patent: Feb. 3, 1987

[54] STIRRING MEMBER FOR LIQUID SUSPENSIONS IN SEALED SPRAY CONTAINERS

[76] Inventor: Göran Törnell, Lennart Torstensonsgatan 3, S-412 56 Göteborg, Sweden

[21] Appl. No.: 795,345

[22] PCT Filed: Feb. 12, 1985

[86] PCT No.: PCT/SE85/00069

§ 371 Date: Oct. 10, 1985

§ 102(e) Date: Oct. 10, 1985

[87] PCT Pub. No.: WO85/03457

PCT Pub. Date: Aug. 15, 1985

[30] Foreign Application Priority Data

Feb. 13, 1984 [SE] Sweden ..... 8400736

[51] Int. Cl.[4] ..... B01F 13/00; B65D 83/14

[52] U.S. Cl. ..... 336/342; 222/394

[58] Field of Search ..... 366/342, 343, 605; 272/1 R; 222/394

[56] References Cited

U.S. PATENT DOCUMENTS 3,705,669 12/1972 Cox et al. ..... 272/1 R 4,056,500 11/1977 Stern ..... 222/394

FOREIGN PATENT DOCUMENTS 2299842 9/1976 Fed. Rep. of Germany ..... 366/342

*Primary Examiner*—Louis K. Rimrodt

*Attorney, Agent, or Firm*—Harness, Dickey & Pierce

[57] ABSTRACT

A stirring member for liquid suspensions in a sealed spray container. The stirring member is formed as an essentially spherical body which is provided along its jacket face with a number of ribs. These are arranged to increase the effects of the stirring activity as the stirring member moves through the liquid suspension.

3 Claims, 3 Drawing Figures

STIRRING MEMBER FOR LIQUID SUSPENSIONS IN SEALED SPRAY CONTAINERS

BACKGROUND OF THE INVENTION

The subject invention concerns an improved stirring member for liquid suspensions in a sealed spray container in the shape of an essentially spheriacal body.

Spray containers holding a liquid suspension comprising a solvent and paint or other products usually contain one or several stirring members which are entended to improve and enhance the mixing of the container contents when the container is shaken, particularly to effect admixture of the solvent and the other product.

Stirring members of this kind should have a weight which is suitable considering the viscosity of the suspension. In addition, they should be sufficiently durable and the material of the members be such that upon their contact with the interior surface of the spray container no material is removed from either the container surface or from the members. Such abraded material would otherwise tend to contaminate the spray liquid and obstruct the spray nozzle.

Hitherto steel balls have been used as stirring members of this kind. These have a suitable weight, are durable and non-abrasive upon their contact with the container material, which often is aluminium. To achieve a sufficient degree of blending of e.g. spray paints it is, however, generally necessary to shake the container very vigorously for at least one minute. The shaking step must be repeated quite often during the painting job in order to maintain the correct mixing proportions between the paint and the solvent. For instance, should the proportion of solvent in the liquid being discharged from the container be too high there is a serious risk that the paint applied to the painted object starts to "run". When paints known as "metallic" which contain reflecting particles are used there is also a considerable risk that the result of the painting job will be unsatisfactory because the reflecting particles become unevenly distributed on the painted surface. Good painting results therefore depend very highly on how often and how thoroughly the spray can is shaken, which obviously is both time-consuming and tedius.

SUMMARY OF THE INVENTION

The purpose of the subject invention is to provide a stirring member for liquid suspensions in a sealed spray container, which stirring member ensures a more efficient blending than has been possible with prior-art devices of this kind. The conditions for the creation of this stirring member have also been that it should be as reliable as prior-art stirring members and not significantly more expensive to manufacture. The stirring member in accordance with the invention is characterized therein that it is provided with a number of ribs extending along the member jacket face, which ribs are designed to increase the stirring effect when the stirring member moves through the liquid suspension.

BRIEF DESCRIPTION OF THE DRAWINGS

The invention will be described in closer detail in the following with reference to one embodiment thereof illustrated in the accompanying drawings, wherein.

DETAILED DESCRIPTION OF A PREFERRED EMBODIMENT

Figure 1:
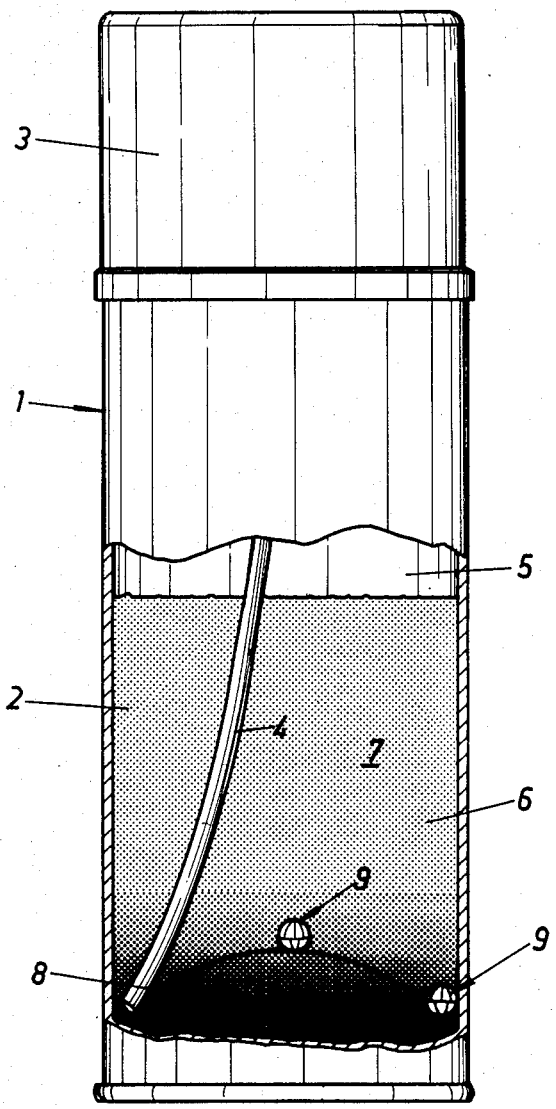
FIG. 1 illustrates in a partly broken view from the side a spray container equipped with stirring members in accordance with the invention.

The spray tin 1 of FIG. 1 consists of a pressurized container 2 and of a valve mechanism which in the drawing figure is covered by a lid 3. From the valve mechanism extends an ascending pipe 4 towards the bottom of the pressurized container 2. The pressurized container 2 holds a propellant gas 5 and a liquid suspension 6 comprising a solvent 7 and a substance 8 having a higher density and collecting, as illustrated in the drawing figure, at the bottom of the container when the latter is stored in its normal upright storing position.

Figure 2:
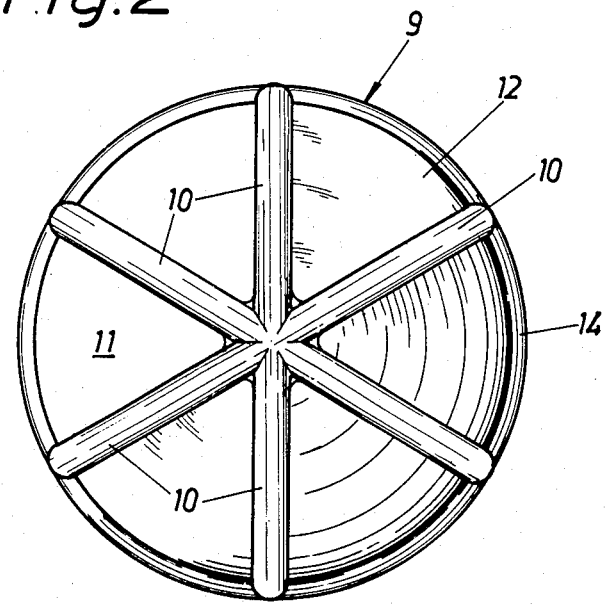
FIGS. 2 and 3 illustrate one such stirring member on an enlarged sclae as seen from two different angles.
Figure 3:
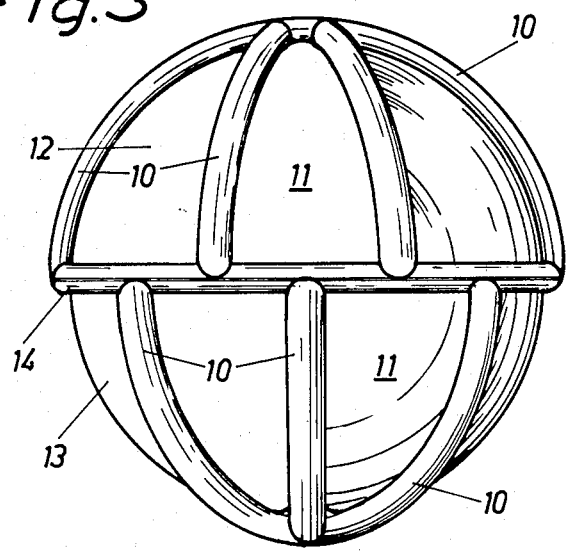

To allow the substance 8 to be mixed into the solvent 7 two ball-shaped stirring members 9, more clearly illustrated in FIGS. 2 and 3, are enclosed inside the pressurized container 2. The stirring member 9 is in the shape of an essentially spherical body which is provided with ribs 10 which extend along the jacket face 11. FIG. 2 shows one half of the sphere 12 where the ribs 10 depart from a point centrally on the jacket face 11 and diverge longitudinally away from this point towards the border line of the opposite half 13 of the sphere. This border line is represented by a latitudinal rib 14 which interconnects the previously mentioned ribs 10. As appears from FIG. 3 the longitudinal ribs 10 on the two sphere halves are mutually displaced so that the ribs 10 on sphere half 12 interconnect with the rib 14 midway between two ribs 10 on the opposite sphere half 13.

When the spray container 1 is shaken the stirring members will be moved forwards and backwards between the solvet 7 and the substance 8. The stirring members formed with the ribs 10 and 14 will then generate more turbulence in the liquid suspension 6 than would be the case, were corresponding spherical smooth-faced members to be used. In addition, substance 8 will adhere to the jacket faces 11 of the stirring members 9 intermediate the ribs 10 and 14 when the stirring members pass through the substance 8. When the stirring members 9 thereafter move through the solvent 7 the substance 8 escapes to the latter in a manner similar to a comet's tail. In addition, upon their contact with the bottom and the walls of the pressurized container the ribs 10 and 14 will scrape off substance adhering thereto and this scraped-off substance will then be atomized in the solvent as the stirring members move through the latter.

Owing to these three different efficiency-increasing measures the mixing of the liquid suspension may be effected at a considerably higher speed than has hitherto been possible with conventional smoothfaced stirring members. Tests have shown that the shaking time required to effect blending may be halved.

The manufacture of stirring members 9 in accordance with the invention preferably is effected with the aid of moulding of a wire blank cut into suitable pieces. This manufacturing method is well known from the manufacture of the balls for ball bearings. The moulding is effected between two hemi-spherical moulds comprising impressions corresponding to FIG. 2. The rib 14 then is formed at the border area between the two mould halves. The cost increases in the manufacture of stirring members in accordance with the invention thus are represented mainly by the cost of the moulds which obviously are more expensive to manufacture. However, distributed over a large number of stirring members 9 manufactured in the moulds the cost increases are negligible. The invention is not limited to the embodiment described above but a variety of modifications are possible within the scope of the appended claims. The rib 14 is not necessary to realize the inventive idea and the rest of the ribs 10 may be shaped and distributed over the jacket face 11 in a manner different from that shown.

What I claim is:

1. An improved stirring member for a liquid suspension in a sealed spray container, said stirring member being in the form of an essentially spherical body, the improvement comprising a plurality of ribs on said stirring member, said ribs extending along the jacket face of said stirring member, said ribs designed to increase the effects of the stirring activity when said stirring member passes through the liquid suspension in said container.

2. An improved stirring member as claimed in claim 1, wherein the ribs on each half of said sphere depart from a point centrally on the surface of the respective half of the sphere and diverge longitudinally from said point towards the border line common to both halves of the sphere.

3. An improved stirring member as claimed in claim 2, wherein along said border line extends latitudinally a further rib interconnecting the rest of the ribs.

* * * * *